US011628486B2

(12) United States Patent
Miyake et al.

(10) Patent No.: US 11,628,486 B2
(45) Date of Patent: Apr. 18, 2023

(54) PRODUCTION METHOD FOR PRESSED COMPONENTS, PRESS FORMING DEVICE, AND METAL SHEET FOR PRESS FORMING

(71) Applicant: JFE STEEL CORPORATION, Tokyo (JP)

(72) Inventors: Hiroto Miyake, Tokyo (JP); Toyohisa Shinmiya, Tokyo (JP); Yuji Yamasaki, Tokyo (JP)

(73) Assignee: JFE STEEL CORPORATION, Tokyo (JP)

( * ) Notice: Subject to any disclaimer, the term of this patent is extended or adjusted under 35 U.S.C. 154(b) by 144 days.

(21) Appl. No.: 16/970,579

(22) PCT Filed: Feb. 21, 2019

(86) PCT No.: PCT/JP2019/006552
§ 371 (c)(1),
(2) Date: Aug. 17, 2020

(87) PCT Pub. No.: WO2019/167792
PCT Pub. Date: Sep. 6, 2019

(65) Prior Publication Data

US 2021/0114076 A1 Apr. 22, 2021

(30) Foreign Application Priority Data

Feb. 28, 2018 (JP) ..... JP2018-034570

(51) Int. Cl.
*B21D 53/88* (2006.01)
*B21D 22/02* (2006.01)

(52) U.S. Cl.
CPC ..... *B21D 53/88* (2013.01); *B21D 22/02* (2013.01)

(58) Field of Classification Search
CPC ..... B21D 22/02; B21D 22/06; B21D 22/20; B21D 22/22; B21D 22/26; B21D 25/00; B21D 25/02; B21D 25/04; B21D 53/88
(Continued)

(56) References Cited

U.S. PATENT DOCUMENTS 9,731,339 B2 8/2017 Miyagi et al.
10,688,551 B2 * 6/2020 Aso ..... B21D 22/26
(Continued)

FOREIGN PATENT DOCUMENTS

CN 104903020 A 9/2015
JP 2004-174531 A 6/2004
(Continued)

OTHER PUBLICATIONS

Mar. 16, 2021 Search Report issued in European Patent Application No. 19760333.5.
(Continued)

*Primary Examiner* — Shelley M Self
*Assistant Examiner* — Teresa A Guthrie
(74) *Attorney, Agent, or Firm* — Oliff PLC

(57) ABSTRACT

A method includes press forming a metal sheet into an intermediate formed product bent out of a plane and forming into a desired press-formed component shape. In a region to be a flange portion, an angle to be bent out of the plane is equal to or less than an angle formed by the flange portion at the curved portion in the press-formed component shape. The projection portion has a largest projection height at the center portion in the longitudinal direction of the region to be the curved portion as seen in the side view, and a longitudinal length of a region to be the top sheet portion is set to coincide with or approach a longitudinal length of the top sheet portion in the press-formed component shape.

5 Claims, 9 Drawing Sheets

(58) Field of Classification Search
USPC ..... 72/347
See application file for complete search history.

(56) References Cited

U.S. PATENT DOCUMENTS

| | | | | |
|---|---|---|---|---|
| 2015/0224563 | A1* | 8/2015 | Aso | B62D 25/08 428/595 |
| 2015/0336158 | A1* | 11/2015 | Miyagi | B21D 53/88 72/361 |
| 2016/0301543 | A1 | 10/2016 | Minezawa et al. | |
| 2016/0375477 | A1 | 12/2016 | Tanaka et al. | |
| 2017/0333972 | A1 | 11/2017 | Nishimura et al. | |

FOREIGN PATENT DOCUMENTS

| | | | |
|---|---|---|---|
| JP | 4709659 | B2 | 6/2011 |
| JP | 2013-027912 | A | 2/2013 |
| JP | 5353329 | B2 | 11/2013 |
| JP | 5733475 | B2 | 6/2015 |
| JP | 2018-020350 | A | 2/2018 |
| WO | 2015/005076 | A1 | 1/2015 |
| WO | 2016/075937 | A1 | 5/2016 |
| WO | 2017/149955 | A1 | 9/2017 |
| WO | 2018/030240 | A1 | 2/2018 |

OTHER PUBLICATIONS

Sep. 28, 2021 Office Action issued in Chinese Patent Application No. 201980013263.7.

Apr. 2, 2019 International Search Report issued in International Patent Application No. PCT/JP2019/006552.

Oct. 31, 2019 Decision to Grant issued in Japanese Patent Application No. 2019-536617.

Sep. 1, 2020 International Preliminary Report on Patentability issued in International Patent Application No. PCT/JP2019/006552.

* cited by examiner

PRODUCTION METHOD FOR PRESSED COMPONENTS, PRESS FORMING DEVICE, AND METAL SHEET FOR PRESS FORMING

TECHNICAL FIELD

The present invention is a technology relating to production of a press-formed component including a curved portion protruding toward a top sheet portion along a longitudinal direction as seen in a side view and having a hat-shaped cross-sectional shape. In particular, the present invention is a technology suitable for production of a vehicle frame component including a portion curved toward a top sheet portion in a side view.

BACKGROUND ART

The vehicle frame component includes, for example, a top sheet portion and vertical wall portions and flange portions continuous thereto, and are shaped to include a portion curved along a longitudinal direction as seen in a side view. When producing such a vehicle frame component from a metal sheet by press forming, a crack or a wrinkle may be formed on a part of the component, which can cause a forming defect. Moreover, problems may occur such as lowered dimensional accuracy due to elastic recovery in a formed product after release. Particularly, in recent vehicle frame components, use of a thin high strength steel sheet as a metal sheet for press forming has been increasing in order to achieve both vehicle lightweighting and collision safety. However, with increased material strength (tensile strength) of the metal sheet, ductility of the metal sheet decreases, so that a large spring-back occurs in a press-formed product. Due to this, when a high tensile strength steel sheet is simply press formed, problems such as cracks, wrinkles, and spring-back have become apparent.

For example, in a press-formed component shape including a top sheet portion and vertical wall portions and flange portions continuous thereto and including, at least one place, a shape curved in such a manner as to protrude toward the top sheet portion as seen in a side view, material shortage on the top sheet portion side may cause a crack, or material excess on flange portion sides may cause a large wrinkle. Furthermore, due to the opening of a cross section caused by spring-back and a longitudinal stress difference occurring between the top sheet portion and the flange portions, poor dimensional accuracy tends to occur, such as lift of end portions in the longitudinal direction of the component in a direction where the curve in the side view becomes loose (a curvature of the curve becomes small). To cope with occurrence of these forming defects, the following countermeasure technologies have conventionally been proposed.

Specifically, for example, PTL 1 describes a technology as countermeasures against cracks on the top sheet portion and wrinkles on the flange portions in a final component shape including, at least one place, a shape curved longitudinally in such a manner as to protrude toward the top sheet portion as seen in a side view. PTL 1 proposes that, by performing drawing while pinching the top sheet portion by a pad and a punch, shear deformation is caused to occur on vertical wall portions of the component, thereby eliminating material shortage on the top sheet portion and material excess on the flange portions.

Additionally, a technology described in PTL 2 is an example of a method for reducing a longitudinal tensile stress of a top sheet portion, which is a stress that causes a spring-back when released. The technology described in PTL 2 produces, in a first forming step, an intermediate formed product that includes a top sheet portion having a smaller curvature radius than in the final component shape to allow it to project in excess, and forms, in a second forming step, such that the top sheet portion projecting in excess in the intermediate formed product is crushed in the final component shape. By doing this, the technology of PTL 2 takes a countermeasure to reduce the stress causing a spring-back by generating compressive stress in the longitudinal direction of the component.

Furthermore, PTL 3 proposes that a first forming step produces an intermediate formed product provided with a protruding and recessed shape such that a longitudinal line length of a top sheet portion is made longer by a certain amount than that in a final component shape, thereby securing an extra line length, and a second forming step forms the intermediate formed product into the final component shape, so that no excessive tensile deformation is applied to the top sheet portion.

CITATION LIST

PTL 1: JP Pat. No. 5733475
PTL 2: JP Pat. No. 5353329
PTL 3: JP Pat. No. 4709659

SUMMARY OF INVENTION

Technical Problems

However, the method described in PTL 1 may create shear wrinkles due to the shear deformation applied to the vertical wall portions, which may make bonding to another component difficult. Furthermore, the method described in PTL 1 is drawing by which the vertical wall portions are subjected to bending-unbending deformation, due to which the vertical walls of the high strength steel sheet are significantly warped, leading to poor dimensional accuracy.

The methods described in PTL 2 and PTL 3 can reduce the longitudinal tensile stress applied to the top sheet portion. However, it is necessary to provide a recessed shape to the top sheet portion, so that the shape of the component may be changed. Furthermore, the methods described in PTL 2 and PTL 3 have no effect of suppressing opening in the cross-sectional direction, thus limiting improvement in dimensional accuracy.

The present invention has been made in view of the above problems, and it is an object of the present invention to provide a technology for producing a press-formed component, which is capable of producing, with reduced forming defects such as cracks, wrinkles, and lowered dimensional accuracy, a press-formed component having a shape including, at least one place, a shape curved in such a manner as to protrude toward a top sheet portion along a longitudinal direction as seen in a side view.

Solution to Problems

The inventors conducted intensive studies about a press forming method capable of forming, without any cracks and wrinkles, a final component shape that includes a top sheet portion and vertical wall portions and flange portions continuous to the top sheet portion and that includes, at least one place, a shape curved in such a manner as to protrude toward the top sheet portion as seen in a side view, and also capable of suppressing spring-back. As a result of the studies, the present inventors found that material shortage on the top sheet portion and material excess on the flange portions, which are stresses that become factors causing cracks, wrinkles, and spring-back, can be reduced by previously performing stretch forming at a predetermined place in a pre-step before a step of forming into the final component shape to secure a line length likely to be short of material.

The present invention has been made on the basis of such a finding.

To solve the problems, a method for producing a press-formed component according to one aspect of the present invention is a method for producing a press-formed component for producing, by press forming a metal sheet, a press-formed component having a press-formed component shape that has a hat-shaped cross-sectional shape including a vertical wall portion and a flange portion on both sides of a widthwise direction of a top sheet portion and that includes, at one or more places along a longitudinal direction of the top sheet portion, a curved portion curved in such a manner as to form a protrusion toward the top sheet portion as seen in a side view, the method including: a first forming step of press forming the metal sheet into an intermediate formed product that has a shape such that, as seen in a side view, a region to be the curved portion is bent out of a plane in a direction of the protrusion at a bending position set at a center portion in the longitudinal direction of the region to be the curved portion and that includes a projection portion formed by projecting regions to be the top sheet portion and the vertical wall portion in a direction of the protrusion relatively with respect to a region to be the flange portion; and a second forming step of performing bending on the intermediate formed product to form a ridge line between the top sheet portion and the vertical wall portion and a ridge line between the vertical wall portion and the flange portion in the press-formed component shape, in which, in the region to be the flange portion, an angle to be bent out of the plane in the first forming step is set to equal to or less than an angle formed by the flange portion at the curved portion in the press-formed component shape as seen in the side view; the projection portion in the first forming step is shaped to have a projection height that becomes smaller from the center portion in the longitudinal direction of the region to be the curved portion along the longitudinal direction as being further away from the center portion, as seen in the side view; and a difference between a longitudinal length of the region to be the top sheet portion and a longitudinal length of the top sheet portion in the press-formed component shape is set to equal to or less than 10% of the longitudinal length of the top sheet portion in the press-formed component shape.

Additionally, a press forming device according to one aspect of the present invention is a press forming device for use in the second forming step of the method for producing a press-formed component according to the one aspect of the present invention, the press forming device including an upper die including bending blades for bending the metal sheet at ridge line portion positions to perform bending of the vertical wall portion and the flange portion and a lower die including a punch, in which the bending blades are configured to move at an angle selected from a range of from 0 degrees to 90 degrees with respect to a pressing direction to perform the bending.

In addition, a metal sheet for press forming according to one aspect of the present invention is a metal sheet for press forming to be formed into a press-formed component shape that has a hat-shaped cross-sectional shape including a vertical wall portion and a flange portion on both sides of a widthwise direction of a top sheet portion and that includes, at one or more places along a longitudinal direction of the top sheet portion, a curved portion curved in such a manner as to form a protrusion toward the top sheet portion in a side view, the metal sheet having a shape such that, as seen in the side view, a region to be the curved portion is bent out of a plane in a direction of the protrusion at a bending position set at a center portion in the longitudinal direction of the region to be the curved portion, and including a projection portion formed by projecting regions to be the top sheet portion and the vertical wall portion in the direction of the protrusion with respect to a region to be the flange portion, in which, in the region to be the flange portion, an angle to be bent out of the plane is equal to or less than an angle formed by the flange portion at the curved portion in the press-formed component shape as seen in the side view; the projection portion is shaped to have a projection height that becomes smaller from the center portion in the longitudinal direction of the region to be the curved portion toward the longitudinal direction as being further away from the center portion, as seen in the side view; and a difference between a longitudinal length of the region to be the top sheet portion and a longitudinal length of the top sheet portion in the press-formed component shape is set to equal to or less than 10% of the longitudinal length of the top sheet portion in the press-formed component shape.

Advantageous Effects of Invention

According to the aspects of the present invention, forming defects such as cracks, wrinkles, and lowered dimensional accuracy can be reduced in the production of a press-formed component having a hat-shaped cross-sectional shape and including, at least one place, a shape curved in such a manner as to protrude toward a top sheet portion along a longitudinal direction as seen in a side view.

An example of a forming defect due to lowered dimensional accuracy is a spring-back caused by, for example, a longitudinal stress difference between the top sheet portion and the flange portions. According to the aspects of the present invention, such a spring-back can be suppressed to small.

BRIEF DESCRIPTION OF DRAWINGS

FIG. 1 is a diagram illustrating a final component shape in which a top sheet portion is curved in a such a manner as to protrude upward in a longitudinal direction as seen in a side view and shape parameters, in which

DESCRIPTION OF EMBODIMENTS

Figure 1A:
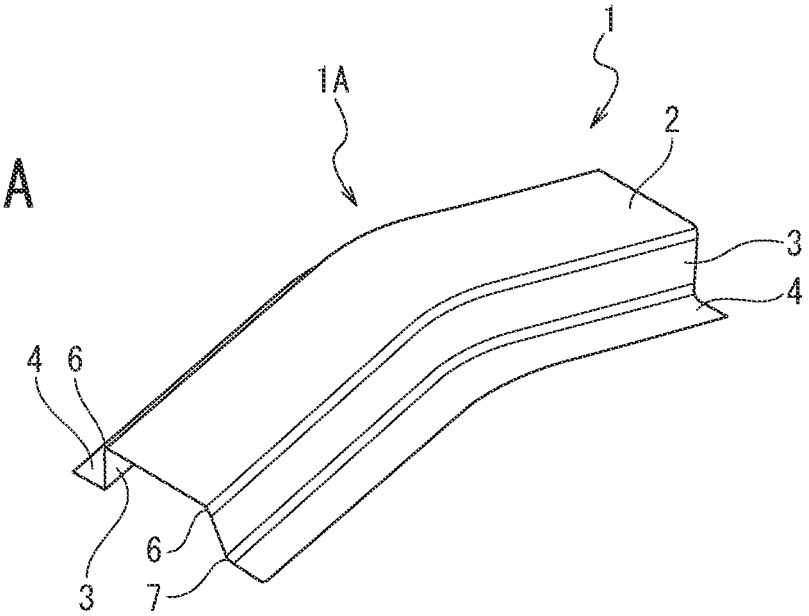
FIG. 1A is a perspective view.

Next, embodiments of the present invention will be described with reference to the drawings.

Herein, the following description will be given by exemplifying a case where a metal sheet 10 is press formed into a final component shape (a press-formed component shape 1) that has a hat-shaped cross-sectional shape including a top sheet portion 2 and a vertical wall portion 3 and a flange portion 4 respectively continuous on both sides of a widthwise direction of the top sheet portion 2 and that includes, at one place, a curved portion 1A curved in such a manner as to form a protrusion toward the top sheet portion 2 along a longitudinal direction of the top sheet portion 2 as seen in a side view.

Figure 1B:
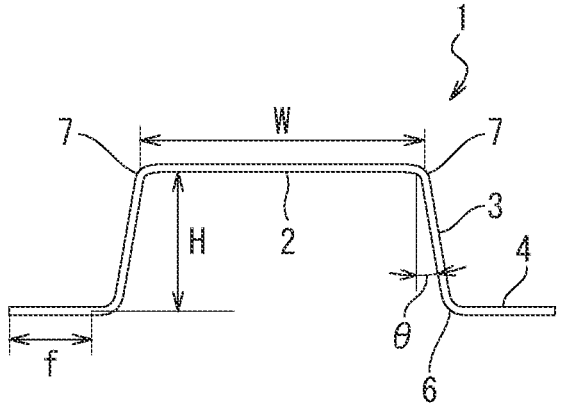
FIG. 1B is a cross-sectional view.

The present invention is not limited to the shape including, at only one place, the curved portion 1A curved in such a manner as to form a protrusion toward the top sheet portion 2 as seen in the side view, as illustrated in FIG. 1. The present invention is also a technology effective on composite component shapes including both a curved shape protruding toward the top sheet portion 2 and a curved shape protruding toward the flange portions and component shapes including the curved portion 1A protruding toward the top sheet portion 2 at two or more places along the longitudinal direction. FIG. 2 illustrates examples of the press-formed component shape to which the present invention can be applied.

<Metal Sheet>

The shape of the metal sheet for use in press forming of the present embodiment is not particularly limited, and for example, a metal sheet having a developed shape of the final press-formed component shape 1 developed on a plane or a metal sheet having a simple rectangular shape is used.

The following description will be given of an example of use of a flat rectangular metal sheet as the metal sheet for press forming.

Additionally, the material of the metal sheet is also not particularly limited. However, the present embodiment is suitably effective on a metal sheet made of a high strength material, particularly, a steel material having a material tensile strength of 590 MPa or more.

<Forming Method>

Figure 3:
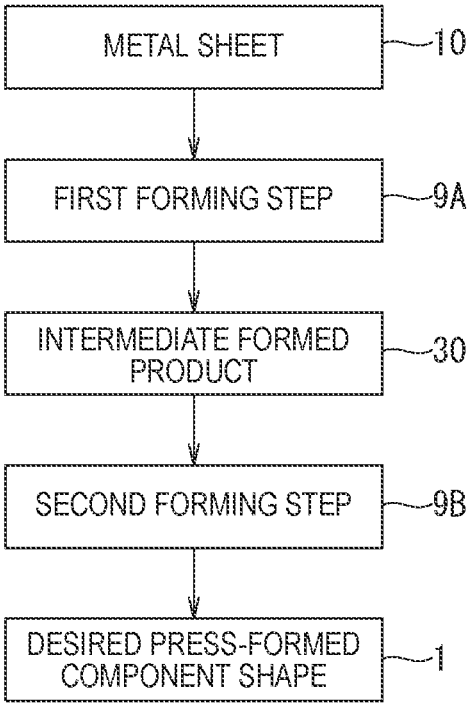
FIG. 3 is a diagram describing forming steps according to an embodiment based on the present invention.

A method for producing a press-formed component according to the present embodiment includes a first forming step 9A and a second forming step 9B, as illustrated in FIG. 3. Since the present embodiment uses the rectangular sheet material as the metal sheet 10, a trimming step is included after the second forming step 9B. When using a sheet material having the developed shape as the metal sheet 10, the trimming step is not necessarily required.

Figure 4:
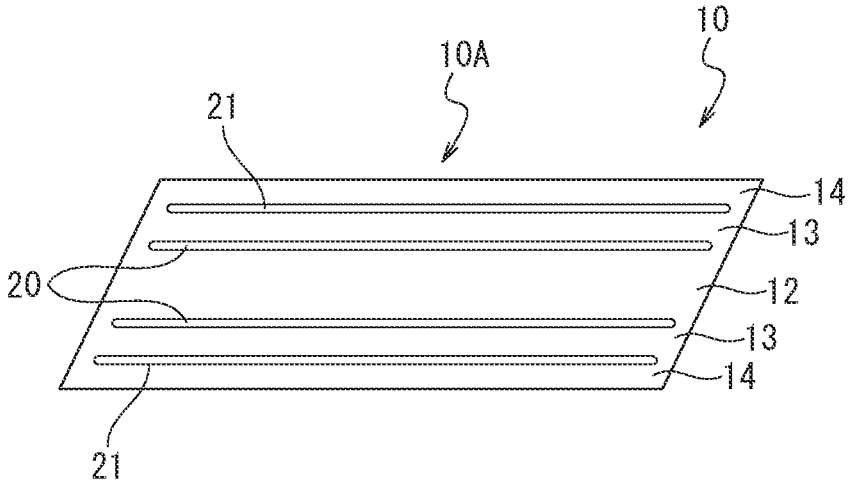
FIG. 4 is a diagram illustrating an example of a metal sheet provided with a bead shape.

Additionally, for a purpose of improving accuracy of the bending in the second forming step 9B, the method may include, as processing before the second forming step 9B, a ridge line pre-processing step of forming a bead shape or a crease shape at least one position of positions corresponding to ridge lines on the metal sheet 10. Specifically, as illustrated in FIG. 4, the ridge line pre-processing step is a step of forming, at least one position of a position corresponding to a ridge line 6 between the top sheet portion 2 and the vertical wall portion 3 and a position corresponding to a ridge line 7 between the vertical wall portion 3 and the flange portion 4, at least one bead shape 20, 21 or crease shape is formed that extends in a direction along the corresponding ridge line 6, 7. The ridge line pre-processing step may be performed in the first forming step 9A or may be set as a separate step before or after the first forming step 9A.

Although FIG. 4 illustrates an example provided with the bead shape, a crease shape may be provided as described above, instead of the bead shape 20, 21. Additionally, the bead shape 20, 21 and the crease shape may be used in combination in such a manner that the bead shape 20, 21 is provided at a part, and the crease shape is provided at the other part. In addition, only some of the ridge lines 6, 7 located at the positions of the ridge line 6, 7 may be formed with the bead shape 20, 21. Furthermore, the bead shape or crease shape does not have to be formed over the entire length of one ridge line 6, 7, and may be formed intermittently along the position of the ridge line 6, 7. When forming the bead shape 20, 21 or crease shape at a part of the entire length of the position of the ridge line 6,7, it is preferable to, for example, set so that a total length of the bead shape 20, 21 is equal to or more than ⅓ of the entire length of the corresponding ridge line 6, 7.

Furthermore, when further improvement in dimensional accuracy is desired or when provision of a necessary shape (such as an embossed shape) to the component is desired, a forming step for, for example, restrike may be added as a step subsequent to the second forming step 9B.

<First Forming Step 9A>

The first forming step 9A is a step of performing stretch forming on the flat metal sheet 10 to obtain an intermediate formed product 30 as the metal sheet 10 to be used in the second forming step 9B.

Figure 5:
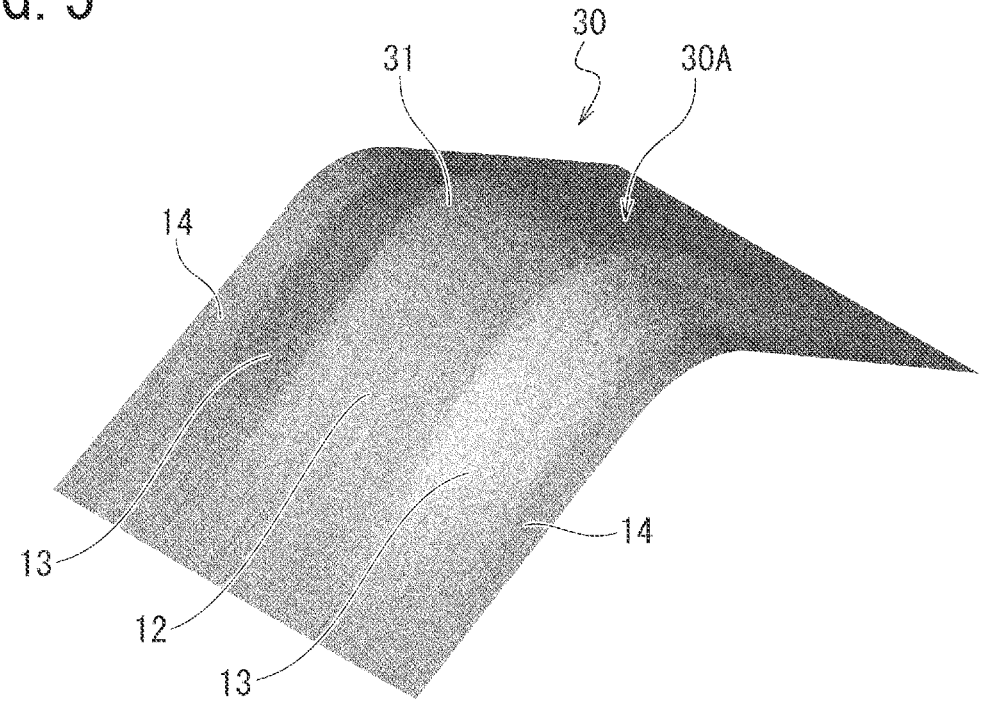
FIG. 5 is a diagram illustrating an example of an intermediate formed product.

In the first forming step 9A, as illustrated in FIG. 5, the metal sheet 10 is press formed into the intermediate formed product 30 that has a shape such that, as seen in a side view, at a bending position 31 set at a center portion in the longitudinal direction of a region to be the curved portion 1A forming a protrusion toward the top sheet portion 2, the region to be the curved portion 1A is bent out of a plane in a direction of the protrusion and that includes a projection portion 30A formed by stretch forming. The shape of the projection portion 30A is a shape such that regions to be the top sheet portion 2 and the vertical wall portion 3 (a top sheet portion forming position 12 and a vertical wall portion forming position 13) project in the direction of the protrusion relatively with respect to a region to be the flange portion 4 (a flange portion forming position 14). In other words, in the projection portion 30A, an angle of the projection along the longitudinal direction on a widthwise center portion side (a side where the region to be the top sheet portion is located) is smaller than an angle of the projection along the longitudinal direction on a widthwise end portion side (a side where the region to be the flange portion is located), as seen in the side view.

Herein, in the present embodiment, an angle β to be bent out of the plane (an out-of-plane bending angle β) in the region to be the flange portion 4 (the flange portion forming position 14) is set to equal to an angle α (see FIG. 1C) formed by the flange portion 4 at the curved portion 1A in the press-formed component shape 1, as seen in the side view. However, the out-of-plane bending angle β may be smaller than the angle α formed by the flange portion 4 at the curved portion 1A in the press-formed component shape 1, as seen in the side view (see FIG. 6). A lower limit value of the out-of-plane bending angle β is a larger angle than an angle at which a crack is assumed to occur due to the bending, and the angle β is, for example, 90 degrees or more. Herein, the out-of-plane bending angle β is an angle on the side where the flange portion 4 is located, and thus is an obtuse angle of less than 180 degrees.

Figure 6:
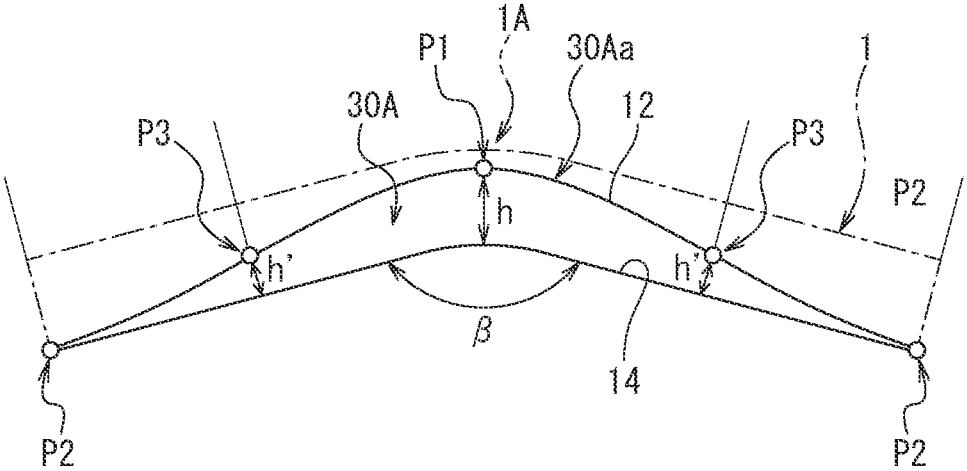
FIG. 6 is a side view illustrating an example of a shape of a projection portion.

The projection portion 30A has a shape such that, as seen in the side view, a height of projection decreases from the center portion of the longitudinal direction in the region to be the curved portion 1A toward the longitudinal direction as being further away from the center portion (see FIGS. 5 and 6). In other words, as seen in the side view, the projection height at the center portion (position P1) of the longitudinal direction in the region to be the curved portion 1A is the largest. The projection height is based on the flange portion forming position 14, and is defined, for example, as a height in a direction from the position of the flange portion forming position 14 toward a perpendicular direction. The height may be a height in a vertical direction.

Additionally, regarding the projection height of the projection portion 30A at the top sheet portion forming position 12, the shape of the projection portion 30A is set such that a difference between a longitudinal length in the region to be the top sheet portion 2 and a longitudinal length of the top sheet portion 2 in the desired press-formed component shape 1 is equal to or less than 10% of the longitudinal length of the top sheet portion 2 in the press-formed component shape 1. The present embodiment is designed such that the difference between the lengths is zero.

When designed as above, if the top sheet portion 2 has the same height (flat) in a widthwise direction in the desired press-formed component shape 1, the top sheet portion forming position 12 in the projection portion 30A is also designed to be the same (flat) in shape in the widthwise direction.

In addition, the projection height at the vertical wall portion forming position 13 in the projection portion 30A is set so as to be an inclined surface such that the projection height gradually increases from the flange portion forming position 14 toward the top sheet portion forming position 12 along the widthwise direction (see FIGS. 5 and 6).

Herein, a formation position of the projection portion 30A along the longitudinal direction is preferably formed in such a manner as to not only include the region to be the curved portion 1A but also extend to a position to be a linear portion on both sides of the longitudinal direction of the projection portion 30A. By performing bending out of the plane as described above, it is possible to set high a projection height h of a projection vertex P1 located at the center portion in the longitudinal direction of the region to be the curved portion 1A. However, lengthening skirts on left and right in the longitudinal direction of the projection portion 30A can suppress an increase in a slope of a profile 30A*a* from the projection vertex P1 located at the center portion in the longitudinal direction of the region to be the curved portion 1A toward the left and right longitudinal directions.

Next, with reference to FIG. 6, a description will be given of an example of setting of the profile 30A*a* (the profile in the longitudinal direction) at the top sheet portion forming position 12 of the projection portion 30A as seen in a side view.

Specifically, as illustrated in FIG. 6, the projection height that is based on the flange portion forming position 14 and is along the longitudinal direction at the top sheet portion forming position 12 in the projection portion 30A as seen in the side view will be set as follows:

Herein, as seen in the side view, the projection height at the projection vertex P1 located at the center portion in the longitudinal direction of the region to be the curved portion 1A is defined as h (mm); the projection height at an end point P2 set at the end portions in the longitudinal direction of the metal sheet 10 is defined as 0 (mm); and the projection height at an intermediate point P3 between the projection vertex P1 and the end point P2 on left and right is defined as h' (mm). The intermediate point P3 is present on a perpendicular line from a midpoint at the flange portion forming position.

Then, a curve smoothly connecting the above-mentioned projection vertex P1, intermediate points P3, and end points P2 is defined as the profile 30A*a* at the top sheet portion forming position 12 of the projection portion 30A as seen in the side view. The curve of the profile 30A*a* is, for example, a spline curve.

In this case, the projection heights h and h' are calculated such that the difference between the longitudinal length in the region to be the top sheet portion 2 (the top sheet portion forming position 12) and the longitudinal length of the top sheet portion 2 in the desired press-formed component shape 1 becomes zero.

The projection height h' at the intermediate point P3 is preferably set to satisfy the following expression (1):

$$(1/3)\cdot h \le h' \le (1/2)\cdot h \quad (1)$$

Each end point P2 to be set may be set at a position closer to the projection vertex P1 side rather than the end portion in the longitudinal direction of the metal sheet 10.

Additionally, when there is an adjacent curved portion 1B, the end point P2 to be set may be set at a previously set position between the target curved portion 1A and the adjacent curved portion 1B instead of the position of the end portion of the metal sheet 10.

Figure 7:
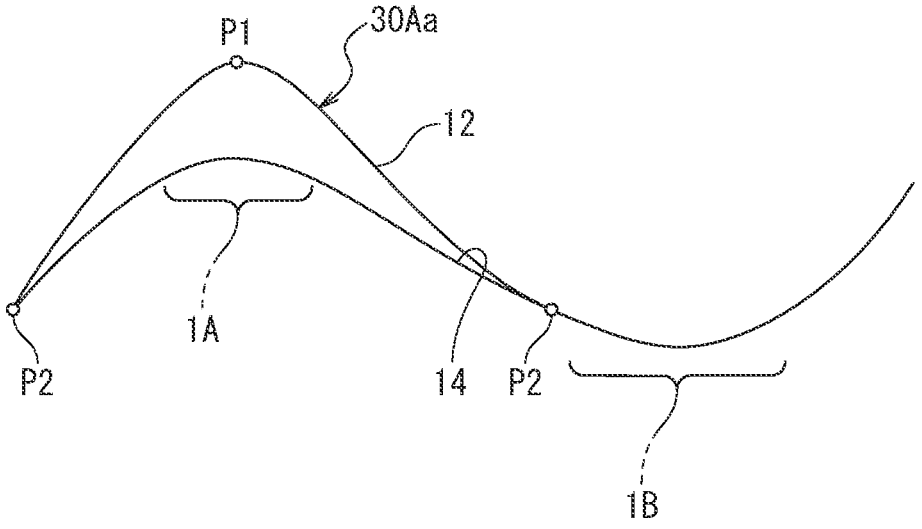
FIG. 7 is a side view illustrating another example of a profile shape of the projection portion.

When the curved portion 1B adjacent to the target curved portion 1A has a curved portion shape protruding toward the flange portion side, the end point P2 is set, for example, as illustrated in FIG. 7, at a boundary position between the adjacent curved portion 1B shape and an adjacent linear portion.

Figure 8:
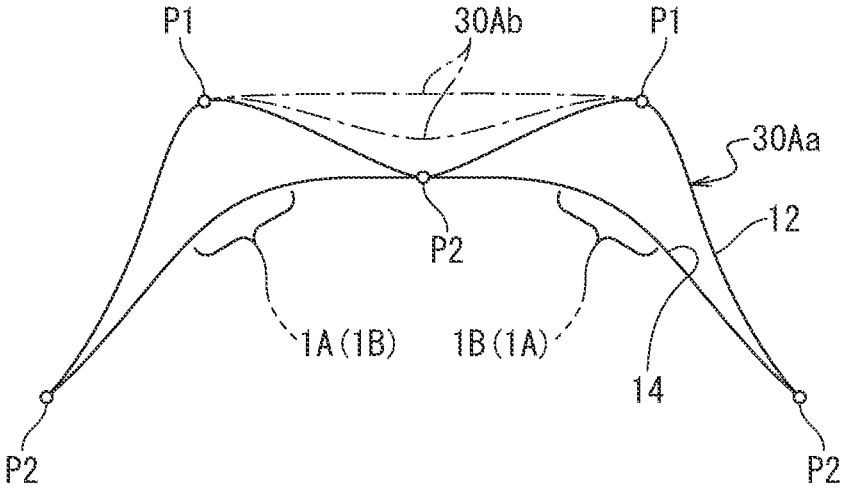
FIG. 8 is a side view illustrating another example of the profile shape of the projection portion.

In addition, as illustrated in FIG. 8, when the curved portion 1B adjacent to the target curved portion 1A has a curved portion shape protruding toward the top sheet portion 2, the end point P2 is set, for example, at a center portion in the longitudinal direction of the adjacent curved portion 1B. When the target curved portion 1A and the adjacent curved portion 1B both have the curved portion shape protruding toward the top sheet portion 2, the end point P2 may be set at the end portions of the metal sheet 10. In this case, one projection portion 30A includes two projection vertices P1, in which a profile between the two projection vertices P1 may have, for example, a linear shape connecting the two projection vertices P1 or a profile 30A*a* shape (see reference sign 30A*b*) connecting the two projection vertices P1 and the above-mentioned intermediate point P3 set therebetween by a catenary curve.

(Forming Method in First Forming Step 9A)

Next, an example of a forming method in the first forming step 9A will be described.

In the first forming step 9A, stretch forming of the metal sheet 10 is performed.

In this case, first, the angle β for bending the flat metal sheet 10 out of the plane is set. The present embodiment performs the bending at an angle equal to the angle α formed by the flange portion 4 as the final component shape is seen in the side view. However, the angle β when bending may be smaller than that.

Additionally, first, when stretch forming of the projection portion 30A is performed, the present embodiment calculates a line length that is required to be secured for a material excess or shortage in the longitudinal direction that occurs on the top sheet portion 2 and the flange portions 4 in the desired press-formed component shape 1.

Figure 1C:
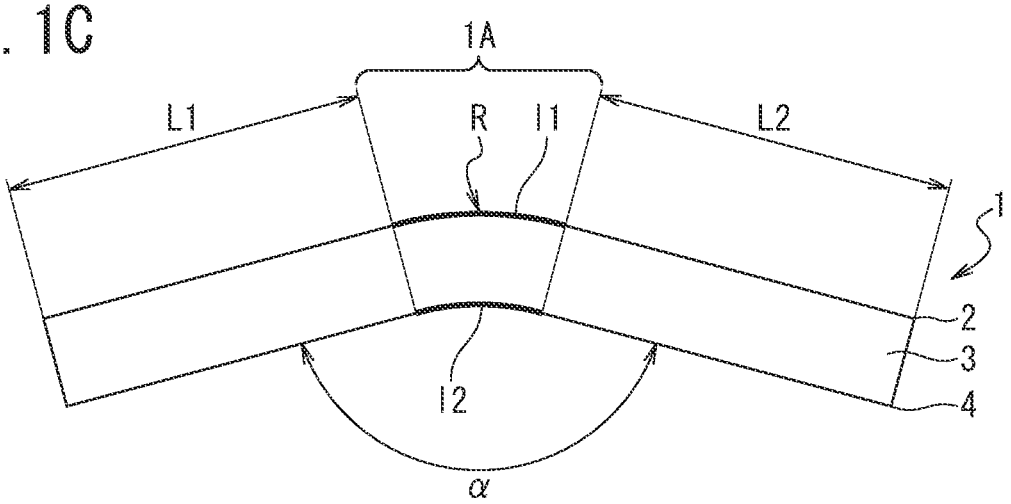
FIG. 1C is a side view.
Figure 2A:
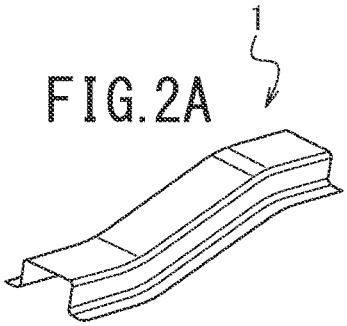
FIG. 2 is a diagram illustrating examples of other press-formed component shapes to which the present invention can be applied.
Figure 2B:
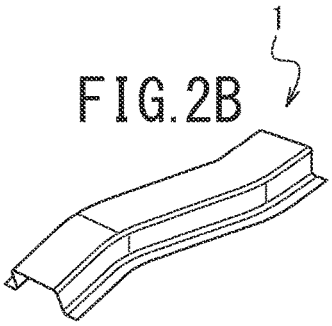
Figure 2C:
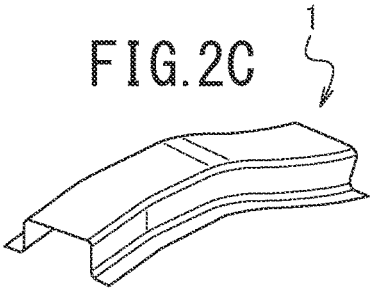
Figure 2D:
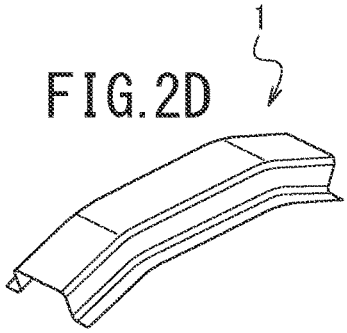
Figure 2E:
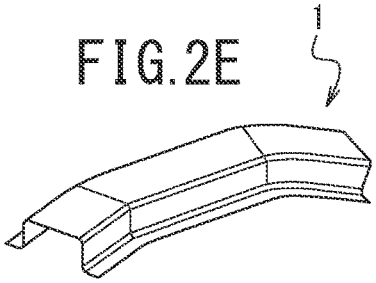
Figure 2F:
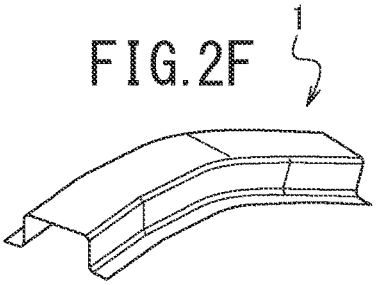
Figure 2G:
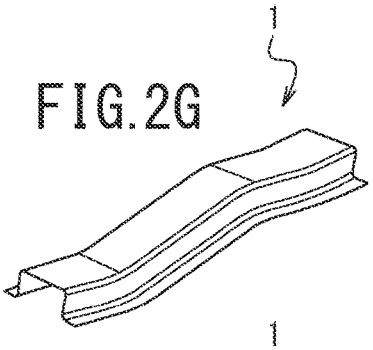
Figure 2H:
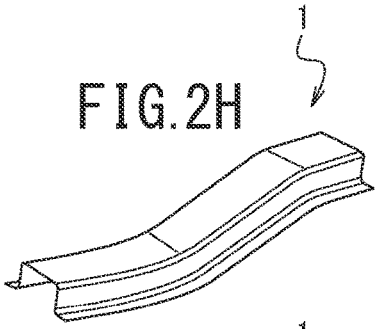
Figure 2I:
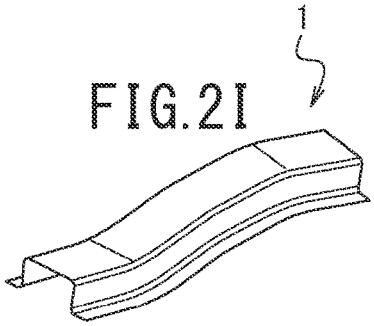
Figure 2J:
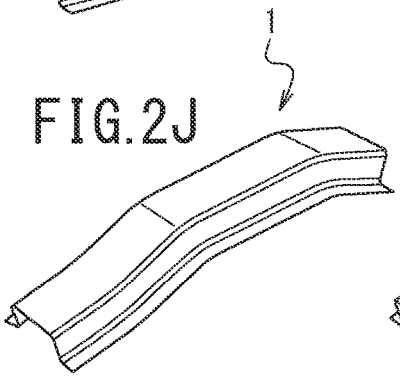
Figure 2K:
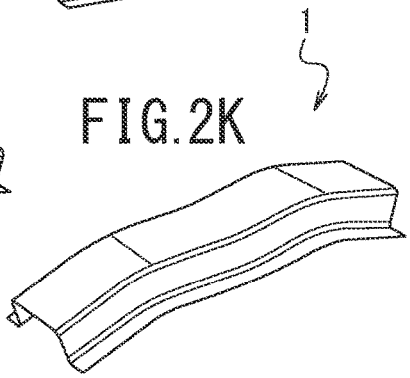

As illustrated in FIG. 1C, in the case of a component curved toward the top sheet portion 2 as seen in a side view, a difference between a line length in the longitudinal direction of the top sheet portion 2 and a line length in the longitudinal direction of the flange portion 4 occurs at the position of the curved portion 1A. In this case, from the desired press-formed component shape 1, a line length 11 in the longitudinal direction of the curved portion 1A on the top sheet portion 2 side is calculated by the following expression. Herein, R (mm) represents a curvature radius of the curved portion 1A on the top sheet portion 2; α (degrees) represents an angle formed by the flange portion 4 curved in the longitudinal direction; and H (mm) represents a height of the vertical wall portion 3.

$$l1=2\pi R\times(180-\alpha)/360$$

Similarly, a line length 12 in the longitudinal direction of the curved portion 1A on the flange portion 4 side is calculated by the following expression:

$$l2=2\pi(R-H)\times(180-\alpha)/360$$

Accordingly, a line length Δl (mm) required to be secured is calculated by the following expression:

$$\Delta l=12-l1=2\pi H\times(180-\alpha)/360$$

Subsequently, a projection shape in the first forming step 9A for securing the above-mentioned line length Δl is designed. First, a shape such that the projection height is the highest at the center of the curved portion 1A in the longitudinal direction is designed. In this case, as illustrated in FIG. 6, a point that is distant by h (mm) perpendicularly from a center of the curved portion 1A in the longitudinal direction at the flange portion forming position 14 is defined as the projection vertex P1. Herein, "perpendicular" means being perpendicular to a surface of the flange portion forming position 14.

Additionally, each end portion in the longitudinal direction of the bent metal sheet 10 is defined as the end point P2. Furthermore, points that are distant by h' (mm) perpendicularly from midpoints between the center of the curved portion 1A in the longitudinal direction at the flange portion forming position 14 and the above end points P2 are each defined as the intermediate point P3. The five points set as above are smoothly connected in the order of the end point P2, the intermediate point P3, the projection vertex P1, the intermediate point P3, and the endpoint P2 to design a protrusion shape as a projection shape at the top sheet portion forming position 12. In this case, the height h and the height h' (<h) are set such that an increased amount of the line length at the top sheet portion forming position 12 becomes the line length Δl.

Figure 9:
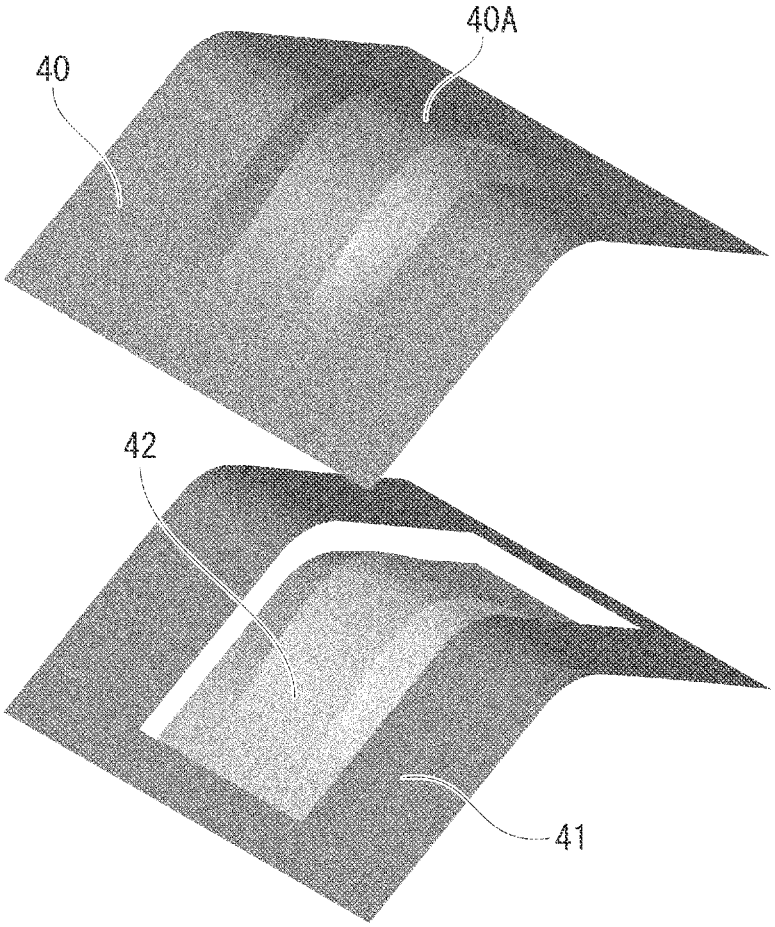
FIG. 9 is a diagram illustrating a method for designing a projection shape in a first forming step.

FIG. 9 illustrates one example of a drawing die for use in the first forming step 9A designed by the above-described method. A lower surface (a pressing surface) of a die 40 has a shape bent out of a plane in such a manner as to protrude upward, and is formed with a protrusion shape 40A having a projection shape designed in such a manner as to extend in a direction intersecting with a position of the bending. Upper end portions of a punch 42 are set to follow the protrusion shape having the projection shape. A blank holder 41 is a component configured to press the flange portion forming positions 14, and is provided with an out-of-plane bending shape that protrudes upward.

Then, the die 40 and the blank holder 41 pinch the flange portion forming positions 14 of the metal sheet 10 to perform out-of-plane bending on the metal sheet 10. Subsequently, the punch 42 is lifted relatively upward to perform drawing of the projection shape on the top sheet portion forming position 12 and the vertical wall portion forming positions 13 of the metal sheet 10, thereby providing the projection portion 30A.

As a result, the intermediate formed-product 30 as illustrated in FIG. 5 is produced as the metal sheet 10 to be press formed in the second forming step 9B.

<Second Forming Step 9B>

The second forming step 9B is a step of performing bending on the intermediate formed product 30 formed in the first forming step 9A to form the ridge lines 6 between the top sheet portion 2 and the vertical wall portions 3 and the ridge lines 7 between the vertical wall portions 3 and the flange portions 4 in the desired press-formed component shape 1, thereby forming the intermediate formed product 30 into the desired press-formed component shape 1.

Figure 10:
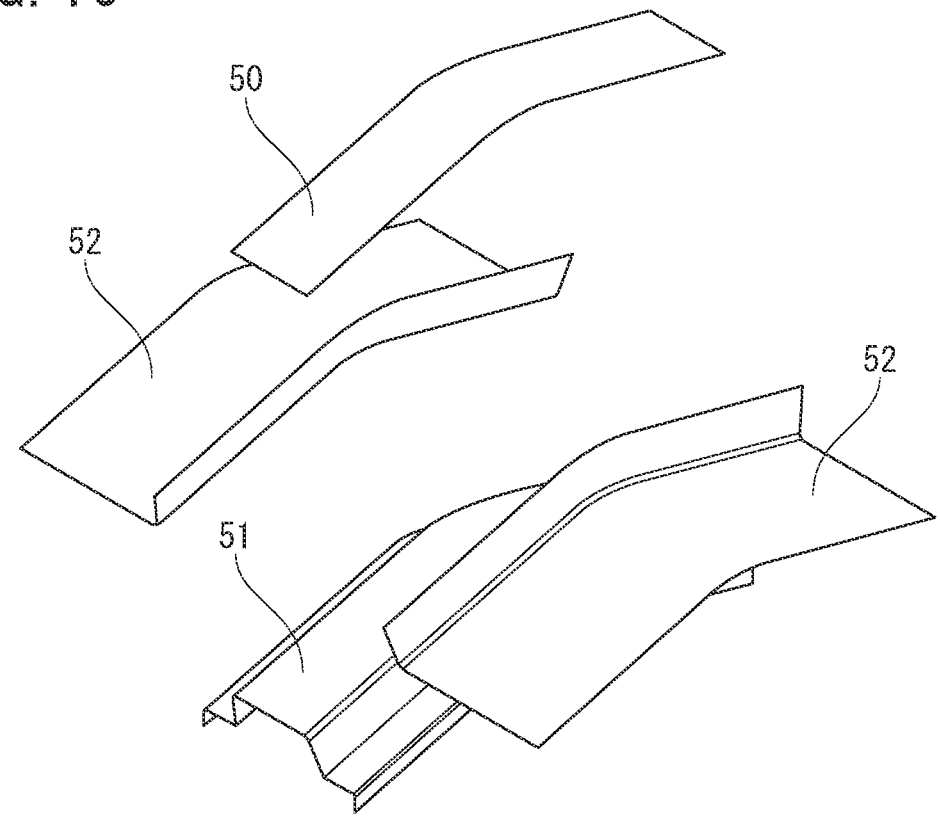
FIG. 10 is a diagram illustrating a method for designing a projection shape in a second forming step.

The second forming step 9B uses a bending die, for example, as illustrated in FIG. 10, configured to perform bending of ridge line portion positions and include an upper die formed by a die 50 and bending blades 52 and a lower die formed by a punch 51.

In the bending die, the top sheet portion forming position 12 of the metal sheet 10 is pinched by the punch 51 and the die 50, and in this state, the bending blades 52 on left and right are moved down to a forming bottom dead center toward the punch 51 to perform bending of the vertical wall portions 3 and the vertical wall portions 3.

Figure 11:
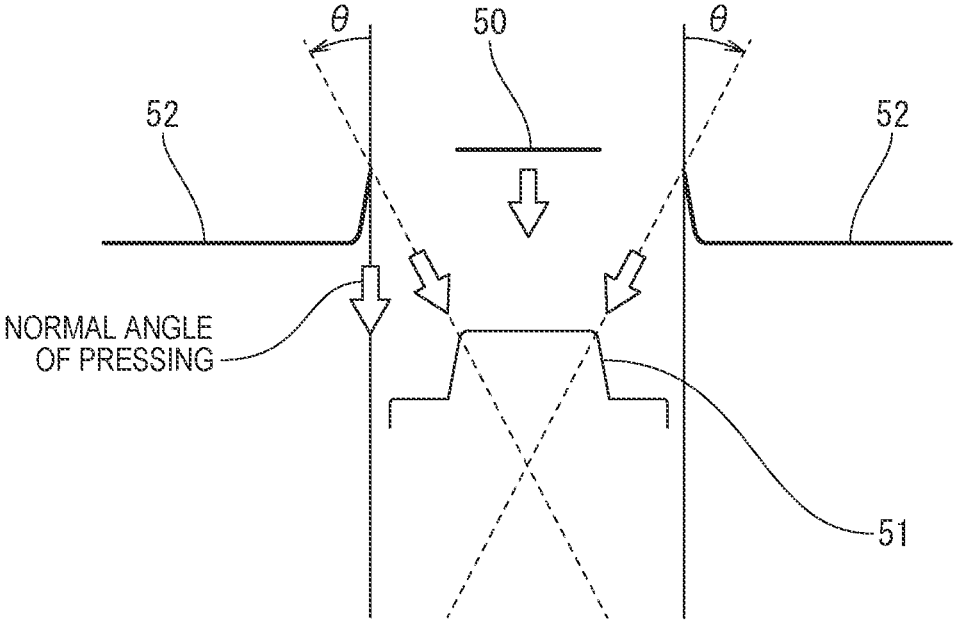
FIG. 11 is a diagram illustrating movement of a bending die in the second forming step.

In this case, as illustrated in FIG. 11, the bending blades 52 are preferably configured to perform the forming by moving at an angle ranging from 0 degrees to 90 degrees, and preferably from 0 degrees to 45 degrees, with respect to a normal angle of pressing, toward a direction away from the punch 51.

(Effects and Others)

(1) The method for producing a press-formed component of the present embodiment includes the first forming step 9A of press forming the metal sheet 10 into the intermediate formed product 30 that has the shape such that, as seen in a side view, the region to be the curved portion 1A is bent out of a plane in a protruding direction at the bending position 31 set at the center portion in the longitudinal direction of the region to be the curved portion 1A and that includes the projection portion 30A formed by projecting the regions to be the top sheet portion 2 and the vertical wall portion 3 in the protruding direction with respect to the region to be the flange portion 4 and the second forming step 9B of performing bending on the intermediate formed product 30 to form the ridge line 6, 7 between the top sheet portion 2 in the press-formed component shape 1 and the vertical wall portion 3 and the ridge line 6, 7 between the vertical wall portion 3 and the flange portion 4.

Then, in the region 14 to be the flange portion 4, the angle β to be bent out of the plane in the first forming step 9A is set to equal to or less than the angle α formed by the flange portion 4 at the curved portion 1A in the press-formed component shape 1 as seen in the side view.

The projection portion 30A in the first forming step 9A is shaped such that, as seen in the side view, the projection height becomes smaller from the center portion in the longitudinal direction of the region to be the curved portion 1A toward the longitudinal direction as being further away from the center portion, and the difference between the longitudinal length including the projection portion 30A in the region to be the top sheet portion 2 and the longitudinal length of the top sheet portion 2 in the press-formed component shape 1 is set to equal to or less than 10% of the longitudinal length of the top sheet portion 2 in the press-formed component shape 1.

This structure can reduce forming defects such as cracks, wrinkles, and lowered dimensional accuracy in the production of a press-formed component having a hat-shaped cross-sectional shape and shaped to include a shape curved in such a manner as to protrude toward the top sheet portion 2 at least one place along the longitudinal direction as seen in a side view. An example of poor dimensional accuracy is a spring-back due to a longitudinal stress difference between the top sheet portion 2 and the flange portions 4. However, according to the aspect of the present invention, such a spring-back can be suppressed to small.

Herein, when forming the projection portion 30A on the intermediate formed product 30 to secure the line lengths of the top sheet portion forming position 12 and the vertical wall portion forming positions 13, providing an out-of-plane bending enables securing of longer line lengths by the projection portion 30A.

(2) In the present embodiment, regarding the projection height of the projection portion 30A at the top sheet portion forming position 12, when, as seen in the side view, the projection height at the projection vertex P1 located at the center portion in the longitudinal direction of the region to be the curved portion 1A is defined as h (mm), a position previously set between two curved portions 1A in a case where there are the target curved portion 1A and an adjacent curved portion 1A or each end portion in the longitudinal direction of the metal sheet 10 is defined as the end point P2, in which the projection height at the end point P2 is set to 0 (mm), and the projection height at the intermediate point P3 between the projection vertex P1 and the end point P2 is defined as h' (mm), the projection height h' is set to satisfy the following expression (1):

$$(1/3)\cdot h \le h' \le (1/2)\cdot h \quad (1)$$

This structure enables provision of an appropriate shape of the projection portion 30A.

(3) In the present embodiment, in processing before the second forming step 9B, at least one position of the position corresponding to the ridge line 6 between the top sheet portion 2 and the vertical wall portion 3 and the position corresponding to the ridge line 7 between the vertical wall portion 3 and the flange portion 4, at least one bead shape 20, 21 or crease shape is formed that extends in the direction along the corresponding ridge line 6, 7.

This structure can further ensure bending at the ridge line-formed positions in the second forming step 9B, which improves formability.

(4) The press forming device for use in the second forming step 9B in the present embodiment includes the upper die including the bending blades 52 for bending the metal sheet 10 at the ridge line portion positions to perform bending of the vertical wall portions 3 and the flange portions 4 and the lower die including the punch 51, in which the bending blades 52 are configured to move at any angle of from 0 degrees to 90 degrees with respect to a pressing direction to perform the bending. Preferred is from 0 degrees to 45 degrees, and more preferred is from 5 degrees to 40 degrees.

With this structure, the bending in the second forming step 9B is performed with high formability.

(5) The present embodiment may use, as the metal sheet 10 for press forming to be press formed into the press-formed component shape 1 that has the hat-shaped cross-sectional shape including the vertical wall portion 3 and the flange portion 4 on both sides of the widthwise direction of the top sheet portion 2 and that includes, at one or more places along the longitudinal direction of the top sheet portion 2, the curved portion 1A curved in such a manner as to protrude toward the top sheet portion 2 in the side view, the metal sheet 10 that has the shape such that, as seen in a side view, a region to be the curved portion 1A is bent out of a plane in a protruding direction at a bending position set at a center portion in the longitudinal direction of the region to be the curved portion 1A and that includes the projection portion 30A formed by projecting regions to be the top sheet portion 2 and the vertical wall portion 3 in the protruding direction with respect to a region to be the flange portion, in which in the region to be the flange portion 4, an angle to be bent out of the plane is equal to or less than an angle formed by the flange portion 4 at the curved portion 1A in the press-formed component shape 1 as seen in the side view; the projection portion 30A is shaped such that, as seen in the side view, the projection height becomes smaller from the center portion in the longitudinal direction of the region to be the curved portion 1A toward the longitudinal direction, as being further away from the center portion; and a difference between a longitudinal length including the projection portion 30A in the region to be the top sheet portion 2 and a longitudinal length of the top sheet portion 2 in the press-formed component shape 1 is set to equal to or less than 10% of the longitudinal length of the top sheet portion 2 in the press-formed component shape 1.

Use of the above metal sheet 10 enables improvement of formability even in normal bending.

EXAMPLE

Next, Example of the present invention will be described.

Assuming a 1180 MPa grade cold-rolled steel sheet (sheet thickness: 1.4 mm) as the metal sheet 10, a press forming analysis was performed on a component having the shape as illustrated in FIG. 1 was performed. In the present Example, shape parameters for defining the press-formed component shape 1 were set as follows:

<Cross-Sectional Shape Parameters>

Top sheet portion width W: 100 mm

Vertical wall height H: 50 mm

Vertical wall angle θ: 10 degrees

Flange length f: 30 mm

<Bending Parameters in Plan View>

Bending angle α: 150 degrees

Curvature radius R of top sheet portion 2: 200 mm linear cross-sectional length L1: 200 mm Linear cross-sectional length L2: 200 mm In addition, the metal sheet 10 for use in forming was a rectangle with a length of 480 mm and a width of 260 mm Next, the bending angle β when bending the flat metal sheet 10 out of the plane in the first forming step 9A was set to 120 degrees, which was smaller than in the final desired press-formed component shape 1. In this press-formed component shape, the line length ΔL required to be secured by stretch forming at the position 12 corresponding to the top sheet portion 2 of the final component shape was ΔL=26.2 mm from the above-mentioned expression.

To secure the line length obtained by the above calculation, a shape (a profile) as a projection shape was designed by setting the height h of the projection vertex P1 illustrated in FIG. 6 to 24 mm, the height h' of the intermediate point P3 illustrated therein to 10 mm, and the end point P2 to end portions of the metal sheet 10 and smoothly connecting them by a spline curve in the order of the intermediate point P3, the projection vertex P1, the intermediate point P3, and the end point P2.

A drawing analysis was performed by an upper die formed by the die 40 having the shape designed above and a lower die formed by the punch 42 and the blank holder 41 to obtain the intermediate formed product 30. In the drawing, a blank holding force of 50 ton was applied.

Next, in the second forming step 9B, a bending analysis was performed on the intermediate formed product 30 by the bending die illustrated in FIG. 10. In the present forming, the bending blades 52 bending the ridge lines 6, 7 used a cam mechanism for bending at an angle θ inclined by 30 degrees with respect to the pressing direction to perform the forming analysis.

Figure 12:
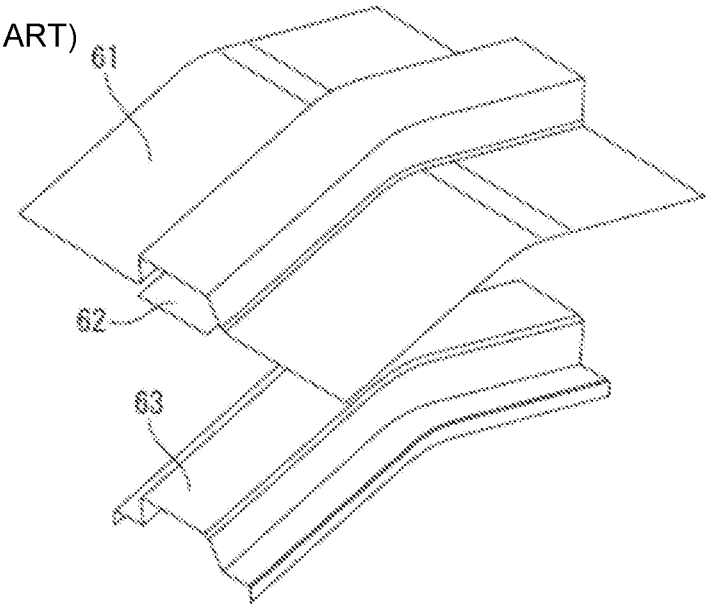
FIG. 12 (RELATED ART)
FIG. 12 is a diagram illustrating a structure of a die in conventional bending in Example.
Figure 13:
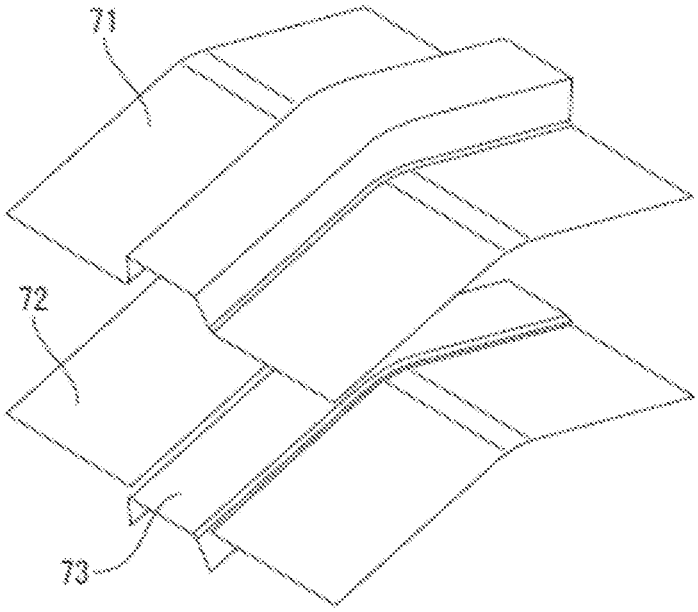
FIG. 13 (RELATED ART)
FIG. 13 is a diagram illustrating a structure of a die in conventional drawing in Example.

In addition, for comparison with the invention method, forming analyses using conventional bending and drawing were also performed together. FIG. 12 illustrates a die used in the bending analysis, and FIG. 13 illustrates a die used in the drawing analysis.

The bending die included an upper die formed by a die 61 and a pad 62 and a lower die formed by a punch 63. The upper die was lowered, and bending was performed while pinching the top sheet portion 2 in the final component shape by the pad 62 and the punch 63. In this case, a pad pressure of 10 ton was applied. Additionally, the drawing die included an upper die formed by a die 71 and a lower die formed by a punch 73 and a blank holder 72. The upper die was lowered, and drawing was performed while pinching the vertical wall portions 3 and the flange portions 4 in the final component shape by the die 71 and the blank holder 72. In this case, the blank holding force was 50 ton.

The forming analyses were performed under the above conditions to calculate respective sheet thickness reduction rate distributions at forming bottom dead centers in the conventional bending, the conventional drawing, and the forming method based on the present invention.

Forming by the conventional bending caused too much excess of material on the flange portions 4 of the final component shape, thereby leading to overlapping wrinkles at two places near the curved portion 1A in the longitudinal direction, which resulted in difficulty in forming.

On the other hand, in the conventional drawing, since the vertical wall portions 3 and the flange portions 4 in the final component shape were pinched by the die 71 and the blank holder 72, the flange portions 4 were able to be formed without any wrinkles.

Furthermore, in the forming method based on the present invention, the flange portions 4 had no wrinkles although the bending was performed finally. In addition, the present target shape had no cracks in all of the forming methods.

Figure 14:
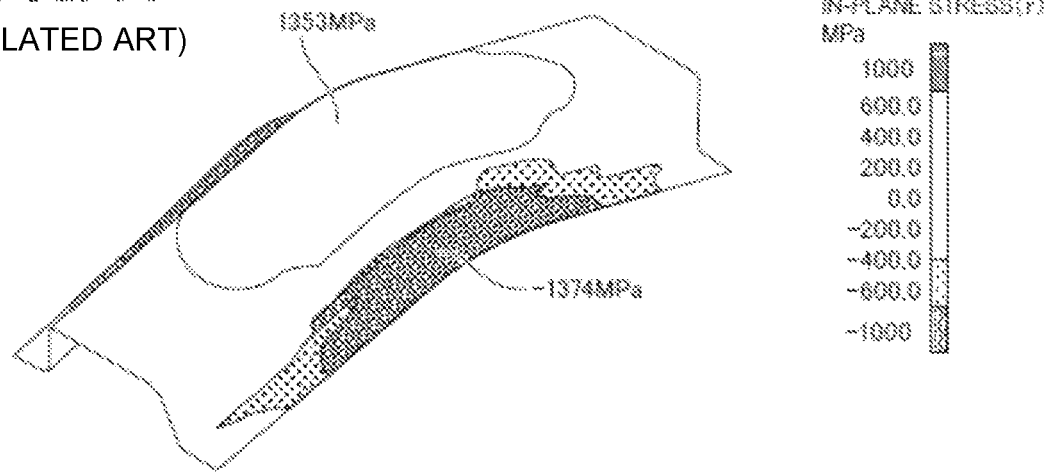
FIG. 14 (RELATED ART)
FIG. 14 is a diagram illustrating a longitudinal axial force distribution at a bottom dead center when formed by the conventional drawing in Example.
Figure 15:
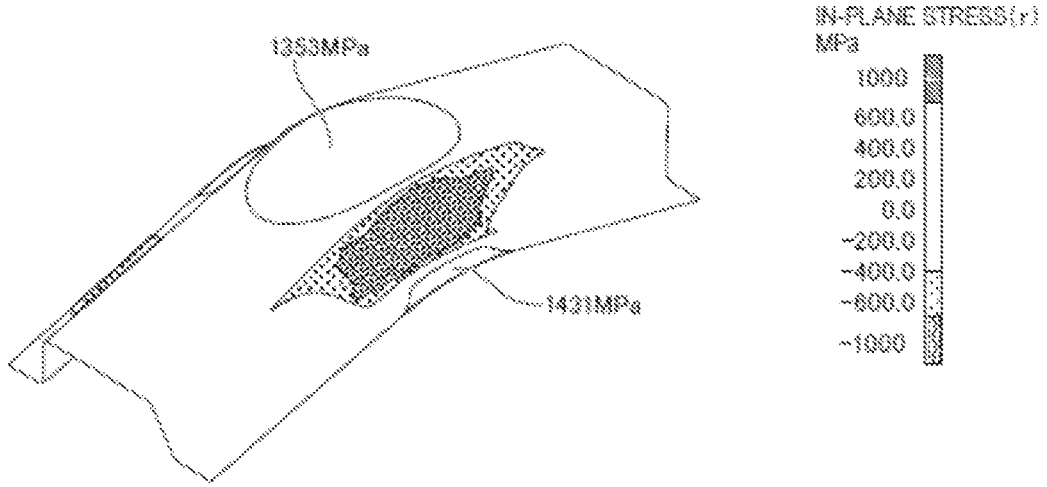
FIG. 15 is a diagram illustrating a longitudinal axial force distribution at a bottom dead center when formed by the method of the present invention in Example.

Next, FIGS. 14 and 15 respectively illustrate a longitudinal sheet thickness center stress distribution at the forming bottom dead center in the conventional drawing and the forming method based on the present invention.

As illustrated in FIG. 14, in the conventional drawing, a large tensile stress was applied to the top sheet portion 2, and conversely, a large compressive stress was generated on the flange portions 4.

On the other hand, as illustrated in FIG. 15, in the forming method based on the present invention, although tensile stress was applied to the top sheet portion 2, the same level of tensile stress was generated even on the flange portions 4. As in the conventional drawing illustrated in FIG. 14, the large tensile stress and compressive stress respectively generated on the top sheet portion 2 and the flange portions 4 become factors that cause spring-back after release.

Subsequently, in each of the conventional drawing and the forming method based on the present invention, a distribution of deviation amounts from a final component shape after release was obtained. The component formed by the conventional drawing had a large difference in the longitudinal sheet thickness center stress between the top sheet portion 2 and the flange portions 4, due to which a large spring-back occurred in such a manner that the end portions in the longitudinal direction were lifted up to 3.3 mm on a left side and 2.5 mm on a right side.

On the other hand, the forming method based on the present invention had almost no difference in the longitudinal sheet thickness center stress between the top sheet portion 2 and the flange faces. Thus, the method enabled forming to be performed without causing almost any spring-back such as lift of the end portions in the longitudinal direction (in which amounts of lift of both end portions in the longitudinal direction were below 0.9 mm each).

Herein, this application claims the benefit of priority of Japanese Patent Application No. 2018-034570 (filed on Feb. 28, 2018), the entirety of which is hereby incorporated by reference. Herein, although the above description has been made with reference to the limited number of embodiments, the scope of the present invention is not limited thereto, and modifications of the respective embodiments based on the above disclosure are obvious to those skilled in the art.

REFERENCE SIGNS LIST

1: Press-formed component shape
1A: Curved portion
2: Top sheet portion
3: Vertical wall portion
4: Flange portion
6, 7: Ridge line
9A: First forming step
9B: Second forming step
10: Metal sheet
12: Top sheet portion forming position
13: Vertical wall portion forming position
14: Flange portion forming position
20, 21: Bead shape
30: Intermediate formed product
30A: Projection portion
30A*a*: Profile
31: Bending position
40: Die
40A: Protrusion shape
42: Punch
50: Die
51: Punch
52: Bending blade
P1: Projection vertex p2: End point P3: Intermediate point β: Bending angle

The invention claimed is:

1. A method for producing a press-formed component by press forming a metal sheet, the press-formed component having a press-formed component shape that has a hat-shaped cross-sectional shape including a vertical wall portion and a flange portion on both sides of a widthwise direction of a top sheet portion and that includes, at one or more places along a longitudinal direction of the top sheet portion, a curved portion curved in such a manner as to form a protrusion toward the top sheet portion as seen in a side view and a linear portion continuous to the curved portion in a longitudinal direction, the method comprising:

a first forming step of press forming the metal sheet into an intermediate formed product that has a shape such that, as seen in the side view, a region to be the curved portion is bent out of a plane in a direction of the protrusion at a bending position set at a center portion in the longitudinal direction of the region to be the curved portion and that includes a projection portion formed by projecting regions to be the top sheet portion and the vertical wall portion in a direction of the protrusion relatively with respect to a region to be the flange portion; and a second forming step of performing bending on the intermediate formed product to form a ridge line between the top sheet portion and the vertical wall portion and a ridge line between the vertical wall portion and the flange portion in the press-formed component shape, wherein, in the region to be the flange portion, an angle to be bent out of the plane in the first forming step is set to equal to or less than an angle formed by the flange portion at the curved portion in the press-formed component shape as seen in the side view, the projection portion in the first forming step extends to a position to be the linear portion, and is shaped to have a projection height that becomes smaller from the center portion in the longitudinal direction of the region to be the curved portion along the longitudinal direction to further away from the center portion, as seen in the side view, in which the projection height at the linear portion position is defined as 0, and the projection height at a vertical wall portion forming position is set to be an inclined surface such that the projection height gradually increases from the flange portion forming position toward the top sheet portion forming position along the widthwise direction, a difference between a longitudinal length of the region to be the top sheet portion and a longitudinal length of the top sheet portion in the press-formed component shape is set to equal to or less than 10% of the longitudinal length of the top sheet portion in the press-formed component shape, and when, as seen in the side view, the projection height at a projection vertex located perpendicularly relative to a surface of the flange portion forming position from a center of the curved portion in the longitudinal direction at the flange portion forming position is defined as h (mm), a position previously set between two curved portions in a case where there are a target curved portion and an adjacent curved portion or each end portion in the longitudinal direction of the metal sheet is defined as an end point, in which the projection height at the end point is set to 0 (mm), and the projection height at an intermediate point located perpendicularly from a midpoint between the projection vertex and the end point is defined as h' (mm), the projection height h' is set to satisfy the following expression (1):

$$(1/3)\cdot h \leq h' \leq (1/2)\cdot h \quad (1).$$

2. The method for producing a press-formed component according to claim 1, wherein, in processing before the second forming step, at least one position of a position corresponding to the ridge line between the top sheet portion and the vertical wall portion and a position corresponding to the ridge line between the vertical wall portion and the flange portion, at least one bead shape or crease shape is formed that extends in a direction along the corresponding ridge line.

3. The method for producing a press-formed component according to claim 1, wherein the metal sheet to be formed is a steel material having a tensile strength of 590 MPa or more.

4. The method for producing a press-formed component according to claim 2, wherein the metal sheet to be formed is a steel material having a tensile strength of 590 MPa or more.

5. The method for producing a press-formed component according to claim 1, wherein an increased amount of a line length at the top sheet portion forming position satisfies the following expression (2):

$$\Delta l = 12 - l1 = 2\pi H \times (180 - \alpha)/360 \quad (2),$$

where H represents a height of the vertical wall portion.

* * * * *